United States Patent [19]

Gigandet

[11] Patent Number: 4,539,469

[45] Date of Patent: Sep. 3, 1985

[54] OVEN CONTROL CIRCUITRY COOLING SYSTEM FOR A DOUBLE-STACK FOOD PREPARATION OVEN ARRANGEMENT

[75] Inventor: Richard W. Gigandet, Fort Wayne, Ind.

[73] Assignee: Lincoln Manufacturing Company, Inc., Fort Wayne, Ind.

[21] Appl. No.: 600,837

[22] Filed: Apr. 16, 1984

[51] Int. Cl.[3] ..... H05B 1/00; F24C 15/32; H05K 7/20

[52] U.S. Cl. ..... 219/412; 219/388; 219/400

[58] Field of Search ..... 219/412, 388, 400, 396, 219/397, 398, 10.55 R; 174/15 R, 16 R; 361/383, 384, 382

[56] References Cited

U.S. PATENT DOCUMENTS

| | | | |
|---|---|---|---|
| 2,237,795 | 4/1941 | Shroyer | 219/398 |
| 2,622,582 | 12/1952 | Pollock | 126/21 R |
| 2,960,633 | 11/1960 | Hall | 361/383 |
| 3,364,838 | 1/1968 | Bradley | 174/16 R |
| 3,633,561 | 1/1972 | Barnett | 126/21 R |
| 3,859,499 | 1/1975 | Evans | 219/396 |
| 3,889,099 | 7/1974 | Nuss | 219/400 |
| 4,027,206 | 5/1977 | Lee | 361/384 |
| 4,100,463 | 7/1978 | Sugie | 219/10.55 R |
| 4,180,049 | 12/1979 | Carr | 219/10.55 R |
| 4,184,945 | 1/1980 | Morgan | 219/10.55 R |
| 4,462,383 | 7/1984 | Henke et al. | 126/21 A |

*Primary Examiner*—Roy N. Envall, Jr.
*Assistant Examiner*—Teresa J. Walberg
*Attorney, Agent, or Firm*—Albert L. Jeffers; John F. Hoffman

[57] ABSTRACT

An oven control box cooling system is provided in a double-stack oven preparation oven arrangement having two vertically aligned food preparation ovens with respective cooking chambers and oven control circuitry. At least the oven control box of the uppermost food preparation oven is provided with a double wall assembly including a mounting wall having the oven control circuitry mounted thereon and an exterior wall spaced apart from and on the opposite side of the mounting wall from the oven control circuitry; the mounting wall and the exterior wall forming therebetween a ventilating compartment having an inlet and an outlet. A ventilating device provides a flow of air through the inlet and ventilating compartment and out the outlet to provide an insulating effect between the oven control circuitry of the uppermost oven and the heat radiating upwardly from the lowermost food preparation oven. An enclosure is mounted on the mounting wall and encloses the oven control circuitry therein, and has an intake opening and an exhaust opening in communication with the inlet in the ventilating compartment, so that a flow of cooling air is moved through the intake opening and over the oven control circuitry for the cooling thereof and then out the exhaust opening to the inlet. At least some of the outlets in the ventilating compartment have louver-like deflectors for laterally and downwardly directing the flow of exhausting air therefrom, thereby deflecting the upwardly radiating heat downwardly and laterally away from the ventilating compartment and enclosure intake openings to prevent the upwardly radiating heat from being drawn through the intake openings of the enclosure.

23 Claims, 5 Drawing Figures

OVEN CONTROL CIRCUITRY COOLING SYSTEM FOR A DOUBLE-STACK FOOD PREPARATION OVEN ARRANGEMENT

BACKGROUND OF THE INVENTION

This invention pertains to food preparation ovens, and more particularly to a cooling system for oven control circuitry in a double-stack food preparation oven arrangement.

One problem of primary concern when dealing with food preparation ovens is the effect of escaping heat on the oven control circuitry, which operates and monitors the ovens during the cooking process. For example, most oven control boxes containing the oven control circuitry are mounted directly on, or in close proximity to, the oven, and if this environment becomes too warm due to the escaping radiating heat from the cooking chamber, the oven control circuitry may provide improper operation or monitoring of the cooking process, or even prematurely fail. Naturally, the occurrence of either of these two situations is highly undesirable since either will result in an improperly cooked food product.

The above problem is particularly exacerbated in a double-stack food preparation oven arrangement comprising two vertically stacked food preparation ovens wherein the upwardly radiating heat from the lowermost oven contacts and heats the oven control circuitry or the mounting surfaces on which the circuitry is disposed. The two primary sources of this escaping radiating heat are generally the cooking chamber and the conveyor device extending through the horizontally disposed oven passageway for conveying cooked food products from the cooking chamber. Another source of the escaping radiating heat can be the oven plenum containing the heat supplying device or apparatus, however, this potential source is generally of secondary importance since it is usually disposed near the back of the oven, while the oven control circuitry is generally disposed near the front of the oven.

Attempts to prevent the overheating of the oven control circuitry, or the mounting surfaces on which the circuitry is disposed, include directing forced air against the circuitry and its mounting surfaces to cool them from the upwardly radiating heat of the lowermost oven. Although these varied methods and their apparatuses do lower somewhat the temperature of the circuitry environment and the mounting surfaces therefor, the apparatuses are naturally undesirable additions to the oven arrangement, and are particularly undesirable for incorporation in a double-stack food preparation arrangement comprising two relatively small cooking ovens, for example, two-foot ovens.

Furthermore, in a double-stack food preparation oven arrangement, the close proximity of the uppermost oven's control circuitry and mounting surfaces to the lowermost oven subjects the circuitry and mounting surfaces to a much hotter environment than if the ovens were situated side-by-side, thereby requiring an inordinate amount of forced cooling air to lower the temperature of the control circuitry environment.

SUMMARY OF THE INVENTION

The present invention provides a solution to the problem of overheating the oven control circuitry and its mounting surfaces by providing, in one embodiment thereof, a double wall assembly having a mounting wall on which the oven circuitry is disposed and an exterior wall spaced apart from and on the opposite side of the mounting wall from the circuitry; the exterior wall being disposed substantially between the mounting wall and the radiating heat. The mounting wall and the exterior wall form therebetween a ventilating compartment having an inlet and an outlet, and a ventilating device is provided for moving a flow of cooling air through the inlet and the ventilating compartment and out the outlet. Thus, the double wall assembly provides a continuous flow of cooling air between the mounting wall and exterior wall to substantially insulate the oven control circuitry from the high temperatures of the radiating heat.

Further cooling of the oven control circuitry is provided by enclosing the circuitry within an enclosure mounted on the mounting plate, wherein the enclosure includes an intake opening and an exhaust opening in communication with the inlet of the ventilating compartment. The ventilating device is disposed within the enclosure between the intake opening and exhaust opening, and moves air through the intake opening over the oven control circuitry for the cooling thereof and out the exhaust opening. The flow of cooling air is then further moved by the ventilating device through the inlet and ventilating compartment for providing a dynamic flow of air therethrough to insulate the circuitry from the radiating heat of the lowermost oven.

Increased insulation of the oven control circuitry and its mounting surfaces is provided by a plurality of outlets in the ventilating compartment wherein some of the outlets have louver-like deflectors to direct the flow of exhausting cooling air downwardly and laterally away from the ventilating compartment and enclosure, thereby deflecting the upwardly radiating heat downwardly and laterally away from the ventilating compartment and enclosure. By deflecting the upwardly radiating heat away from the ventilating compartment and enclosure, an air curtain or buffer zone of cooler ambient air is established between the upwardly radiating heat and the enclosure to prevent the heat from being drawn through the enclosure intake opening.

The enclosure is further provided with a plurality of intake openings partially surrounding the oven control circuitry enclosed in the enclosure. The flow of cooling air drawn through the plurality of intake openings then flows over the oven control circuitry from different directions to further enhance the cooling thereof. h In one form of the invention there is provided in a food preparation oven including a cooking chamber and oven control circuitry, a cooling system for cooling the oven control circuitry from radiating heat comprising a double wall assembly having a mounting wall with the oven control circuitry mounted thereon, and an exterior wall spaced apart from and on the opposite side of the mounting wall from the circuitry. The exterior wall is disposed substantially between the mounting wall and the radiated heat, and the mounting wall and exterior wall form therebetween a ventilating compartment having an inlet for receiving a flow of cooling air and an outlet for exhausting the flow of air. A ventilating device moves the flow of cooling air through the inlet and ventilating compartment and out the outlet so that the oven control circuitry is substantially insulated from the radiated heat.

In a preferred embodiment of the present invention there is provided in a double-stack food preparation oven arrangement including two substantially vertically aligned food preparation ovens having respected cooking chambers and respective oven control circuitry, a cooling system for the oven control circuitry comprising a double wall assembly having a mounting wall with the oven control circuitry of the uppermost food preparation oven mounted thereon, and an exterior wall spaced apart from and on the opposite side of the mounting wall from the circuitry. The exterior wall is generally horizontally disposed substantially between the mounting wall and upwardly radiating heat from the lowermost food preparation oven. The mounting wall and exterior wall form therebetween a ventilating compartment having a generally vertically disposed continuous sidewall and an inlet for receiving a flow of cooling air and an outlet for exhausting the flow of air. A ventilating device moves the flow of cooling air through the inlet and through the ventilating compartment and out the outlet, whereby the oven control circuitry of the uppermost oven is substantially insulated from the upwardly radiating heat of the lowermost oven.

It is an object of the present invention to provide a cooling system for the oven control circuitry in a food preparation oven.

Another object of the present invention is to provide a cooling system for the oven control circuitry in a double-stack food preparation oven arrangement.

Yet another object of the present invention is to provide a cooling system for the oven control circuitry in a food preparation oven that substantially insulates the circuitry from escaping radiating heat.

A further object of the present invention is to provide a cooling system for the oven control circuitry in a food preparation oven that provides a flow of cooling air over the oven control circuitry for the cooling thereof.

A still further object of the present invention is to provide a cooling system for the oven control circuitry in a food preparation oven that deflects radiating heat away from an enclosure enclosing the circuitry and the intake openings of the enclosure.

Yet a further object of the present invention is to provide a cooling system for the oven control circuitry in a food preparation oven that creates an air curtain or buffer zone between the enclosure intake openings and the radiating heat, wherein the buffer zone temperature is substantially lower than the radiating heat temperature.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
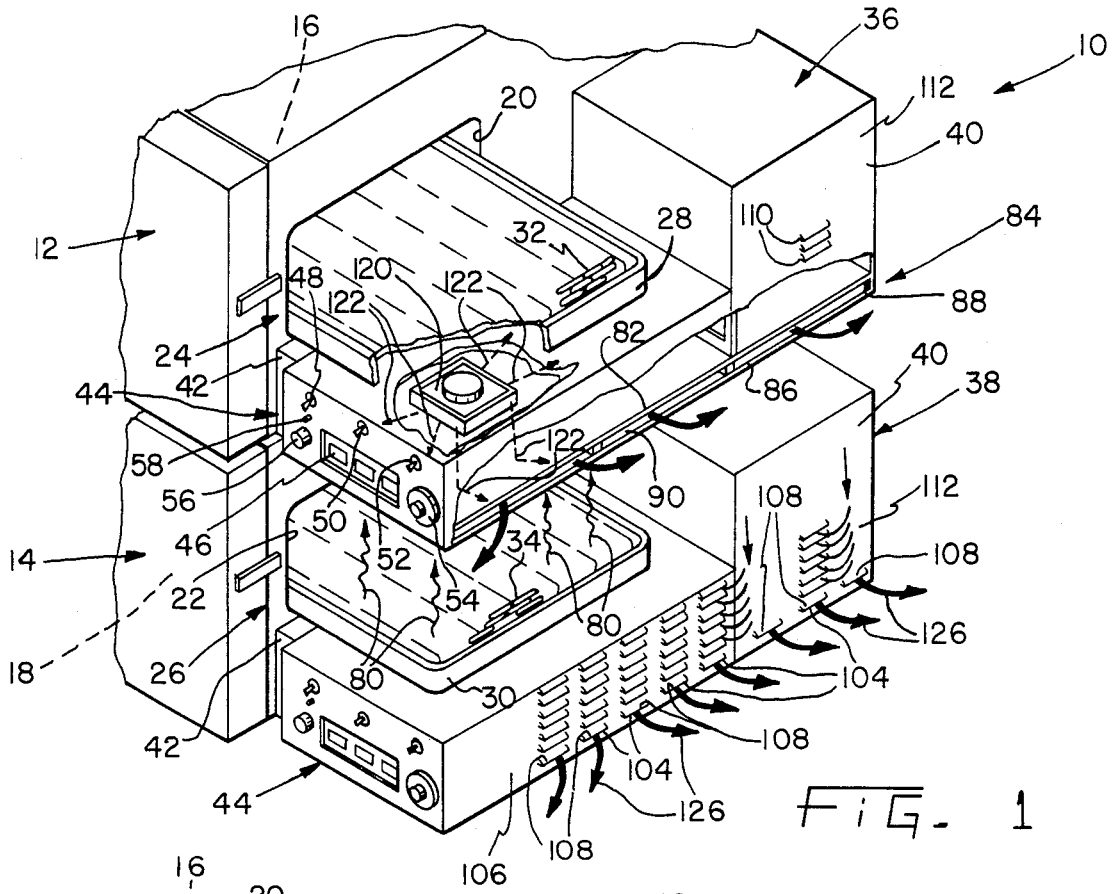
FIG. 1 is a fragmentary, partially broken-away perspective view of a preferred embodiment of the present invention.
Figure 2:
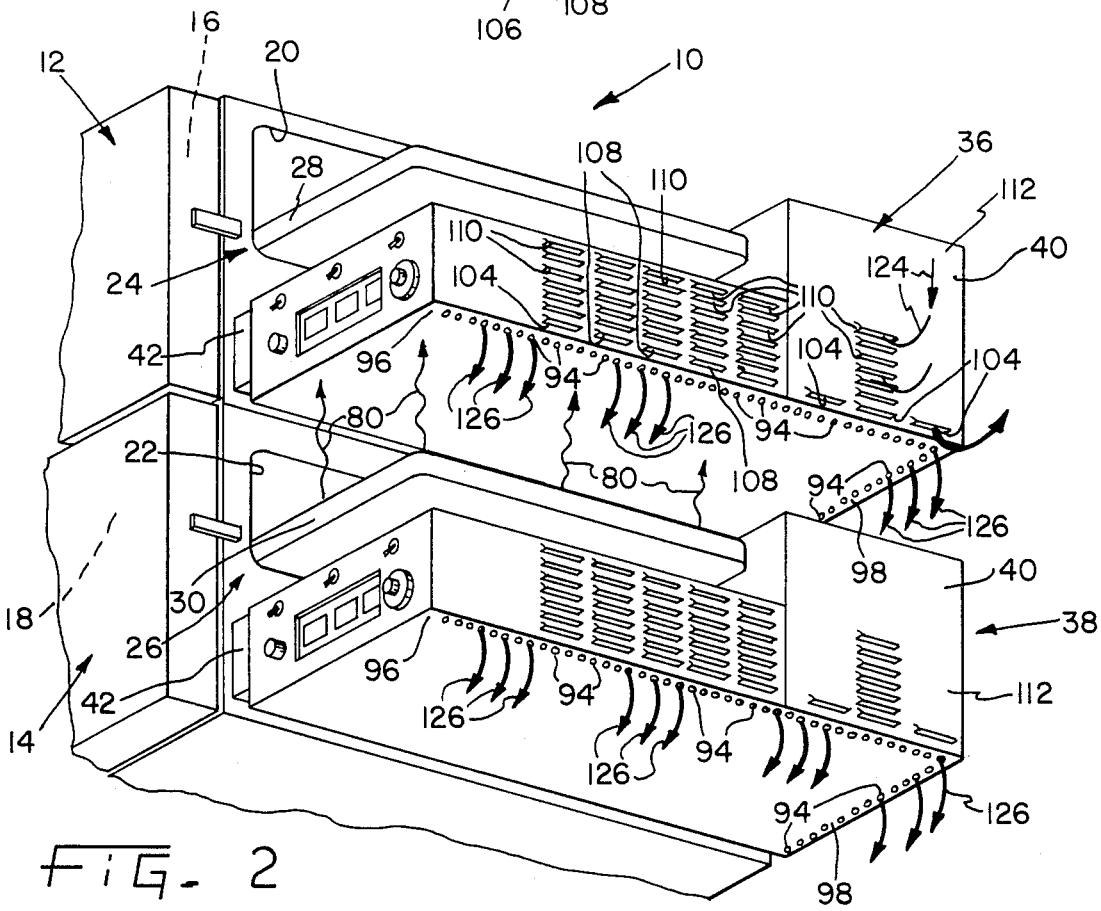
FIG. 2 is a second fragmentary perspective view of the embodiment in FIG. 1.
Figure 3:
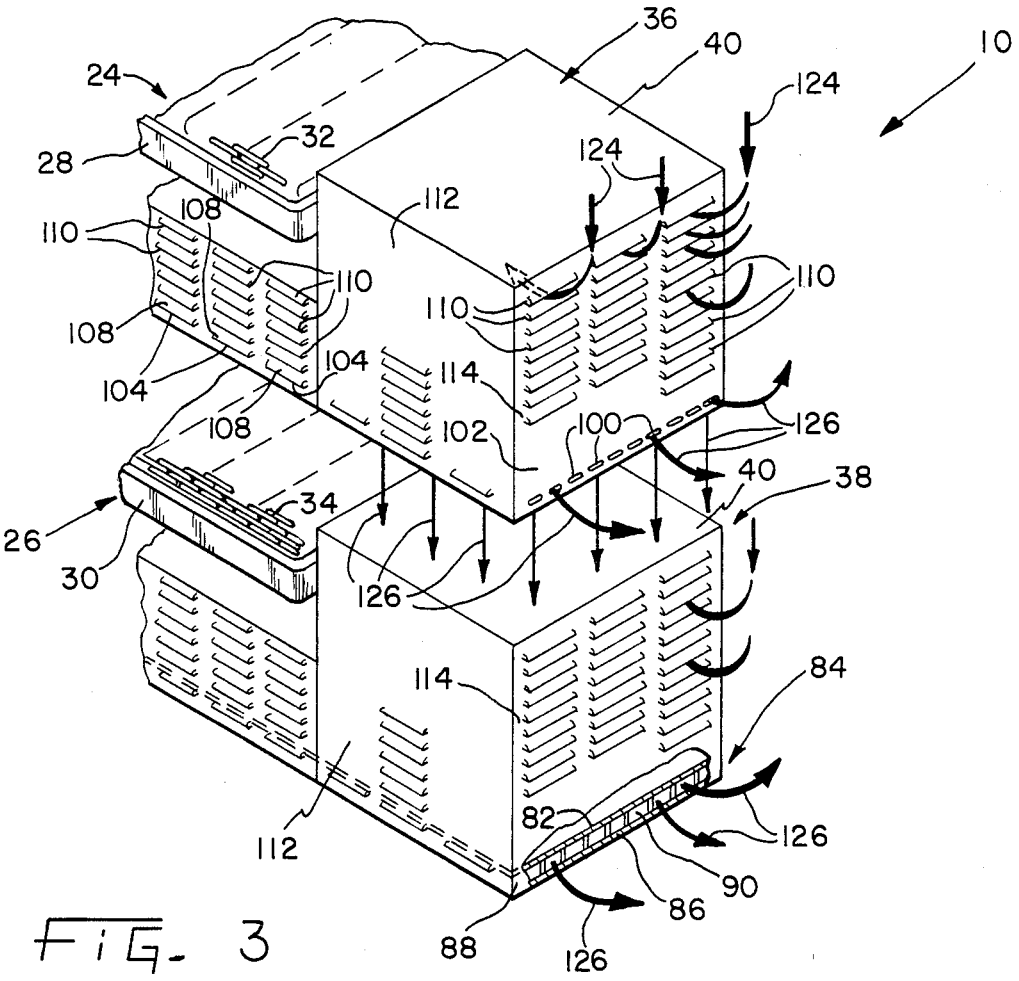
FIG. 3 is a third fragmentary, partially-broken away perspective view of the embodiment in FIG. 1.

Referring primarily to FIGS. 1–3, double-stack food preparation oven arrangement 10 comprises food preparation oven 12 securely positioned over food preparation oven 14. Ovens 12,14 include respective cooking chambers 16,18, which typically include some type of heating element or apparatus for providing heat for cooking a food product, and respective generally horizontally disposed passageways 20,22 through which respective conveyor assemblies 24,26 extend. Conveyor assemblies 24,26 are utilized to convey a food product to be cooked through their respective ovens 12,14, and extend outwardly beyond ovens 12,14 as illustrated to assist in removing the cooked food product. Each conveyor assembly 24,26 comprises a conveyor frame 28,30 and other structural members (not shown) for supporting respective movable continuous belting 32,34. A more detailed description of the structure and operation of a typical food preparation oven representing oven 12 can be found in U.S. Pat. No. 4,462,383, entitled Impingement Food Preparation Oven, and assigned to the assignee of the present invention.

Mounted on the side of each oven 12,14 is a respective control assembly 36,38, which are identical in structure. Thus, only a description of control assembly 36 will be given, and elements common to both assemblies 36,38 will be given the same reference numerals where appropriate.

Control assembly 36 comprises an enclosure 40 connected to oven 12 by four mounting brackets 42, only two of which are illustrated; enclosure 40 being slightly spaced apart from oven 12 approximately one to two inches. The front of enclosure 40 includes a control panel 44 for operating oven 12. Control panel 44 includes digital readout 46 for indicating the baking time in minutes and seconds and oven temperature in degrees Fahrenheit, conveyor on-off switch 48, ventilating fan on-off switch 50, and heat on-off switch 52. Slightly below heat switch 52 is oven temperature adjusting rheostat 54, and slightly below conveyor switch 48 is oven time-adjustment rheostat 56, and time display set button 58.

Figure 4:
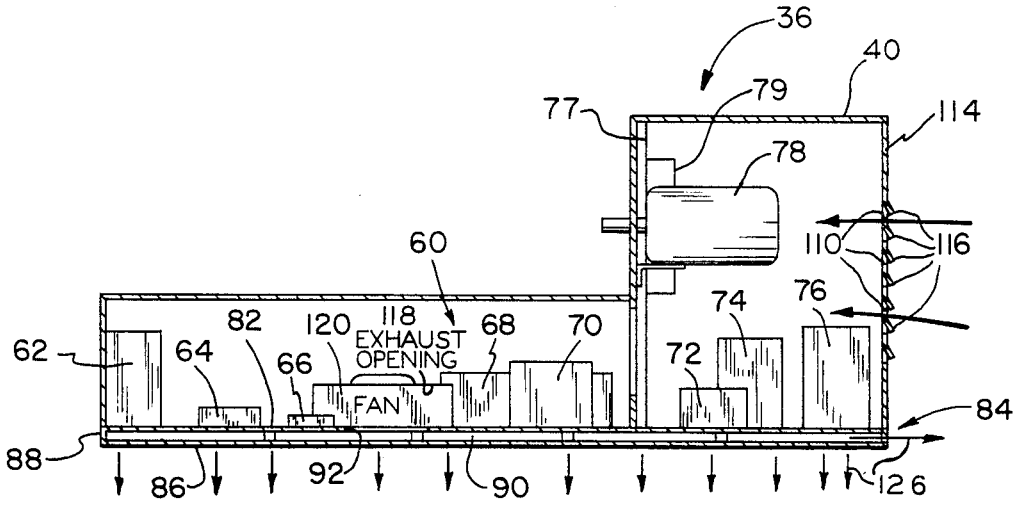
FIG. 4 is a broken-away side elevational view of the control assembly in the embodiment in FIG. 1.

Referring to FIG. 4, enclosure 40 encloses oven control circuitry 60 comprising control panel circuitry 62, display transformer 64, electronic temperature control 66, air pressure switch 68, conveyor motor speed control 70, fan activation relay 72, power cord distribution terminal block 74, heating circuit distribution terminal block 76, mercury relay 79, and motor 78 for operating conveyor assembly 24. Motor 78 and relay 79 are mounted on perforated interior support wall 77. As can be seen from FIGS. 1–3, heat escaping from passageway 22 of bottom oven 14 and from freshly cooked food products being conveyed out of oven 14 by conveyor assembly 26 radiates upwardly, as indicated by the curved arrows 80, and contacts mounting wall 82, upon which oven control circuitry 60 is mounted. As thus far described, the upwardly radiating heat heats mounting wall 82, which inturn radiates the heat to oven control circuitry 60. Eventually, this radiating heat increases the temperature of oven control circuitry 60 to a point at which individual elements will function improperly, or prematurely fail.

To prevent this overheating and eventual failure of the various electrical components comprising oven control circuitry 60, double wall assembly 84 is disposed on the bottom portion of enclosure 40 substantially between oven control circuitry 60 and the upwardly radiating heat, illustrated by arrows 80. Double wall assembly 84 includes mounting wall 82, a spaced-apart exterior wall 86, which is on the opposite side of mounting wall 82 from oven control circuitry 60, and continuous side wall 88. mounting wall 82, exterior wall 86, and continuous side wall 88 form therebetween ventilating compartment 90 having inlet 92 disposed in mounting wall 82 for receiving a flow of cooling air therethrough. The flow of cooling air passing through inlet 92 and ventilating compartment 90 exhausts through a plurality of apertures 94 disposed in side edge portion 96 and back edge portion 98 of exterior wall 86, a plurality of slotted openings 100 (FIG. 3) disposed in the back side 102 (FIGS. 3 and 4) of continuous side wall 88, and a plurality of outlets 104 (FIGS. 1 and 2) disposed in side portion 106 of continuous side wall 88. Each outlet 104 has a respective louver-like deflector 108 disposed downwardly and laterally to direct the flow of exhausting cooling air in a downwardly and lateral direction.

Enclosure 40 includes a plurality of intake openings 110 disposed in its side portion 112 and back portion 114. Each intake opening 110 has a louver-like deflector 116 to prevent foreign particles from entering intake openings 110. Enclosure 40 also includes exhaust opening 118 in fan device 120, which is aligned with inlet 92, and fan device 120 is secured to mounting wall 82.

In operation, fan device 120 is operated to begin and sustain a continual flow of cooling air that is drawn through intake openings 110 to pass over and around oven control circuitry 60 from different directions for the cooling thereof. The flow of cooling air is then urged by fan device 120 through opening 118 and inlet 92 into ventilating compartment 90. The flow of cooling air flows through ventilating compartment 90 in a multi-directional flow pattern as indicated by dashed arrows 122 (FIG. 1), and then flows out of ventilating compartment 90 through apertures 94, slotted openings 100, and outlets 104. As thus far described, the flow of cooling air performs two functions, one being to cool oven control circuitry 60, and the other being to provide an insulating effect for mounting wall 82 and oven control circuitry 60 against the upwardly radiating heat from oven 14 by cooling exterior wall 86.

Figure 5:
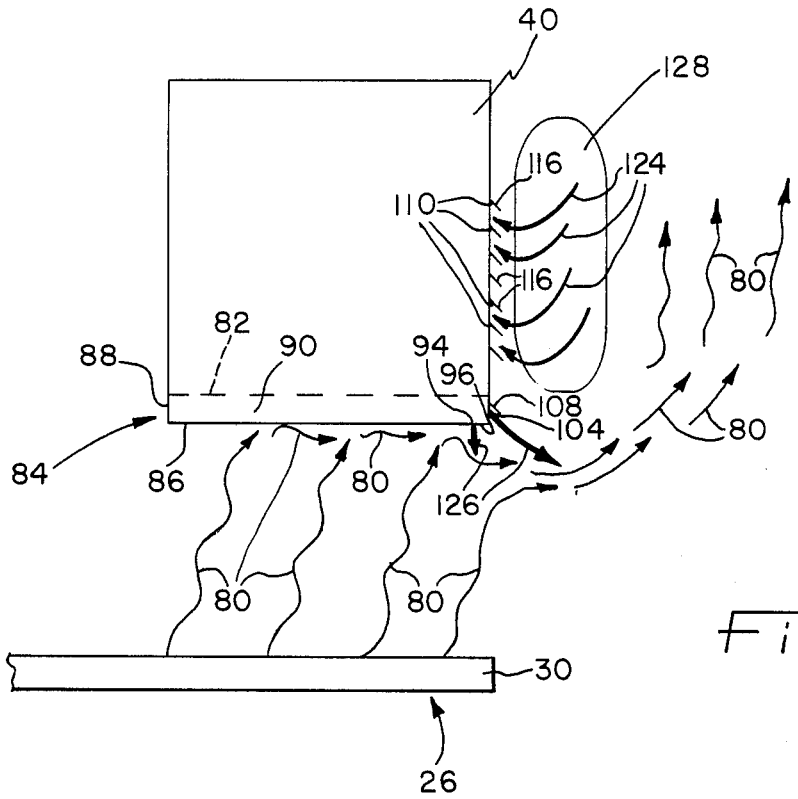
FIG. 5 is a schematic illustrating the effect of the flow of cooling air created by the embodiment in FIG. 1 on an upwardly flow of radiating heat.

Referring to FIG. 5, a more detailed description will be given of the interaction between the flow of cooling air and upwardly radiating heat from oven 14, indicated by curved arrows 80. The flow of cooling air through intake openings 110 is indicated by arrows 124, and the flow of exhausting cooling air is indicated by arrows 126. Typically, during the operation of oven arrangement 10, the surface temperature at conveyor assembly 26 can be 500° F., and will decrease somewhat to approximately 350° F. between conveyor assembly 26 and exterior wall 86. As the heat contacts and flows along exterior wall 86, its temperature is approximately 200° F., which will cause exterior wall 86 to have a temperature of about 160°–170° F. As can be seen, without double wall assembly 84, mounting wall 82 would be at the temperature range of 160°–170° F., and would eventually increase the temperature of circuitry 60 to that same range. However, because of double wall assembly 84, and the flow of cooling air being continually moved through ventilating compartment 90, the surface temperature of mounting wall 82 is only approximately 120° F.; a substantial temperature decrease of about 40°–50° F.

As the radiating heat moves generally horizontally along the bottom surface of exterior wall 86, the interaction between the radiating heat and the exhausting air flow begins to occur. The flow of exhausting air through apertures 94 is directed downwardly toward the radiating heat, thereby deflecting the heat away from side edge portion 96 and a back edge portion 98 of exterior wall 86. Further, the flow of exhausting cooling air through outlets 104 is directed downwardly and laterally by deflectors 108, thereby further deflecting the radiating heat flow downwardly and laterally away from ventilating compartment 90 and enclosure intake openings 110. The temperature of the radiating heat as it is deflected downwardly and laterally by the flow of air through outlets 104 is approximately 160° F. Thereafter, the radiating heat flows upwardly and dissipates in the ambient surrounding air to a temperature of about 5°–10° F. above ambient. Further, the flow of exhausting cooling air through slotted openings 100 in back portion 114 of enclosure 40 deflects the radiating heat laterally away from enclosure intake openings 110.

A unique effect caused by apertures 94, slotted openings 100, and outlets 104 is illustrated in FIG. 5 wherein the downward and lateral deflection of the radiating heat away from ventilating compartment 90 and enclosure 40 creates an air buffer zone or air curtain 128 between intake openings 110 and the upwardly radiating heat. This prevents the warmer radiating heat from being drawn through intake openings 110 and circulated through enclosure 40 and ventilating compartment 90. This effect is further enhanced by exhausting the air flow through apertures 94, slotted openings 100, and outlets 104 at a much greater velocity than the velocity of the intake flow of air through intake openings 110. The velocity differential is primarily due to the effective cross-sectional flow area through ventilating compartment 90 being less than the effective cross-sectional flow area through enclosure 40. This velocity differential is illustrated by the difference in sizes of exhaust arrows 126 and intake arrows 124.

Although only oven 12 was described as having double wall assembly 84 and fan device 120, oven 14 can also be provided with an identical double wall assembly 84 and fan device 120 if desired.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a food preparation apparatus comprising:

an integral stackable oven including a cooking chamber, a conveyor assembly and oven control circuitry said conveyor assembly extending through an opening in a wall said oven;

a cooling system for insulating and cooling said oven control circuitry from a source of radiant heat and including;

a double wall assembly having a mounting wall including first and second sides;

oven control circuitry mounted on said first side and an exterior wall spaced apart from said second side of said mounting wall, said mounting wall and said exterior wall forming therebetween a compartment having an inlet for receiving a flow of cooling air and an outlet in said exterior wall for exhausting the flow of air; and air moving means for forcibly moving said flow of air into said inlet, through said compartment and out of said outlet for forming an air curtain adjacent said oven, whereby said oven control circuitry is substantially insulated from said source of radiant heat by the flow of air between said mounting wall and said exterior wall and by said air curtain.

2. The apparatus of claim 1 further comprising an enclosure mounted on said mounting wall and enclosing oven control circuitry therein, said enclosure including an intake opening and an exhaust opening in communication with said inlet in said compartment, and wherein said air moving means is disposed in said enclosure for drawing said flow of air through said intake opening and over said oven control circuitry and out of said exhaust opening to said inlet, whereby the air cools said oven control circuitry and thereafter passes through said inlet, said compartment and out of said outlet.

3. The apparatus of claim 2 wherein said enclosure includes a plurality of said intake openings spaced about said oven control circuitry whereby said air moving means draws said flow of air through said plurality of intake openings and over said oven control circuitry from different directions, thereby cooling said circuitry.

4. The apparatus of claim 1 including a plurality of said outlets disposed in bottom and side peripheral surfaces of said oven such that air flows from said inlet through said compartment in a multi-directional flow pattern and out said plurality of outlets, thereby providing a substantially evenly distributed insulating effect in said compartment.

5. The apparatus of claim 4 further comprising an enclosure mounted on said mounting wall and enclosing said oven control circuitry, said enclosure having an intake opening and an exhaust opening in communication with said inlet in said ventilating compartment, said air moving means drawing the flow of air through said intake opening and over said oven control circuitry for the cooling thereof and out said exhaust opening to said inlet.

6. The oven of claim 5 wherein said enclosure has a plurality of said intake openings arranged at least partially about said oven control circuitry, and wherein said air moving means moves the air through said plurality of intake openings to flow over said oven control circuitry from different directions to cool said oven control circuitry.

7. The oven of claim 5 wherein selected ones of said outlets open substantially toward the source of radiant heat to deflect heat therefrom away from said oven peripheral surfaces by the flow of air exhausted therefrom.

8. The oven of claim 7 wherein louver-like deflector members are spaced adjacent other ones of said outlets for directing the flow of exhausted air angularly downwardly and laterally away from said compartment and said enclosure to deflect the heat radiated from said heat source away from said peripheral surfaces of said oven compartment and said circuit control enclosure, the flow of air forming an air curtain of cooler air between said compartment, said enclosure and the source of radiant heat.

9. The oven of claim 8 wherein said enclosure has a plurality of said intake openings arranged at least partially about said oven control circuitry, and wherein said air moving means moves the air through said plurality of intake openings to flow over said oven control circuitry from different directions, thereby increasing the cooling effect on said circuitry.

10. The oven of claim 9 wherein said air moving means is a fan device disposed in said enclosure.

11. In a double-stack food preparation oven arrangement including upper and lower food preparation ovens comprising respective cooking chambers conveyor assemblies extending through passageways in sides of said ovens and respective oven control circuitry, a cooling system for said oven control circuitry, comprising:

a double wall assembly in said upper oven having a mounting wall for mounting the oven control circuitry of said upper food preparation oven on a first side thereof and an exterior wall spaced apart from and on a second side of said mounting wall, said exterior wall being generally substantially horizontally disposed between said mounting wall and an upper surface of said lower food preparation oven, said mounting wall and said exterior wall forming there between a ventilating compartment having a generally vertically disposed continuous side wall, said ventilating compartment having an inlet for receiving a flow of cooling air and a plurality of outlets in said exterior and side walls for exhausting the flow of air and for providing a multi-directional flow of air in said compartment, and ventilating means for moving the flow of cooling air through said inlet and said ventilating compartment and out of said outlet, whereby said oven control circuitry is substantially insulated from upwardly radiating heat of said lower food preparation oven by the flow of cooling air between said mounting wall and said exterior wall and the air exhausted from said outlets.

12. The arrangement of claim 1 wherein selected ones of said outlets in said exterior wall are downwardly facing to direct the flow of exhausting cooling air against upwardly radiating heat, thereby deflecting a substantial portion of the radiating heat away from said exterior wall of said ventilating compartment.

13. The arrangement of claim 12 wherein other ones of said outlets are disposed in said continuous side wall to deflect upwardly radiating heat away from said ventilating compartment and said oven control circuitry.

14. The arrangement of claim 13 wherein said other outlets in said continuous side wall have respective louver-like deflector members connected thereto to downwardly and laterally direct the flow of exhausted cooling air against upwardly radiating heat, the radiating heat being deflected downwardly and laterally away from said ventilating compartment and said oven control circuitry to form between said ventilating compartment inlet and the radiating heat an air curtain.

15. The arrangement of claim 11 further comprising an enclosure mounted on said mounting wall and enclosing said oven control circuitry, said enclosure having an intake opening and an exhaust opening in communication with said inlet in said ventilating compartment, said ventilating means cooling said control circuitry by moving the flow of cooling air through said intake opening, over said oven control circuitry and out said exhaust opening to said inlet.

16. The arrangement of claim 15 wherein said ventilating compartment has a plurality of said outlets therein so that the cooling air flows from said inlet through said ventilating compartment in a multi-directional flow pattern to said plurality of outlets, whereby the multi-directional flow of cooling air in said ventilating compartment provides a substantially uniformly distributed insulating effect for said oven control circuitry against the upwardly radiating heat.

17. The arrangement of claim 16 wherein selected ones of said outlets are disposed in a peripheral portion of said exterior wall and adjacent said continuous sidewall, said selected outlets being downwardly facing to direct the flow of cooling air exhausted from said outlets against upwardly radiating heat, thereby deflecting a substantial portion of the heat away from said exterior wall peripheral portion.

18. The arrangement of claim 17 wherein other ones of said outlets are disposed in said continuous sidewall to laterally deflect upwardly radiating heat away from said ventilating compartment and said enclosure enclosing said oven control circuitry.

19. The arrangement of claim 18 wherein said enclosure has a plurality of said intake openings disposed in a side wall thereof and spaced about said oven control circuitry, and wherein said ventilating means moves the cooling air through said plurality of intake openings and over said oven control circuitry from different directions, thereby enhancing the cooling effect on said circuitry.

20. The arrangement of claim 19 wherein said other outlets in said continuous sidewall have respective louver-like deflector members, said louver-like deflector members being downwardly disposed to downwardly and laterally direct the flow of cooling air exhausted therefrom to form an air curtain of cooling air between said ventilating compartment, said enclosure and the upwardly radiating heat.

21. The arrangement of claim 20 wherein the effective air flow cross-sectional area of said ventilating compartment is less than the effective air flow cross-sectional area of said enclosure so that the velocity of the air flowing out of said ventilating compartment outlets is greater than the velocity of the air flow through said enclosure intake openings, thereby increasing the size and effect of said air curtain.

22. The arrangement of claim 20 wherein said inlet of said ventilating compartment and said exhaust opening of said enclosure are disposed in said mounting wall and substantially aligned with each other, and wherein said ventilating means is mounted in said enclosure over said exhaust opening.

23. The arrangement of claim 22 wherein said ventilating means is a fan device.

* * * * *